US009698525B2

(12) United States Patent
Jaeger et al.

(10) Patent No.: US 9,698,525 B2
(45) Date of Patent: Jul. 4, 2017

(54) PLUG TYPE CONNECTOR

(71) Applicant: TE Connectivity Germany GmbH, Bensheim (DE)

(72) Inventors: Stefan Jaeger, Rodgau (DE); Markus Strelow, Moerlenbach (DE); Christian Schrettlinger, Bensheim-Auerbach (DE); Ulrich Buchmann, Eppertshausen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/147,510

(22) Filed: May 5, 2016

(65) Prior Publication Data

US 2016/0248200 A1 Aug. 25, 2016

Related U.S. Application Data

(63) Continuation of application No. PCT/EP2014/073691, filed on Nov. 4, 2014.

(30) Foreign Application Priority Data

Nov. 5, 2013 (DE) ..... 10 2013 222 411

(51) Int. Cl.
*H01R 13/506* (2006.01)
*H01R 13/627* (2006.01)
*H01R 13/639* (2006.01)

(52) U.S. Cl.
CPC ..... *H01R 13/6275* (2013.01); *H01R 13/639* (2013.01)

(58) Field of Classification Search
CPC .. H01R 13/506; H01R 13/516; H01R 13/514; H01R 2103/00; H01R 24/28; H01R 9/26; H01R 9/2608
USPC ..... 439/686, 695, 701, 716
See application file for complete search history.

(56) References Cited

U.S. PATENT DOCUMENTS 3,135,572 A * 6/1964 Curtis ..... H01R 9/26 439/716
3,547,274 A * 12/1970 Sosinkski ..... H01R 13/518 211/26
3,559,813 A * 2/1971 Sosinski ..... H05K 7/02 211/26
3,576,520 A * 4/1971 Stauffer ..... H01R 9/26 257/724
3,708,780 A * 1/1973 Pierce ..... H01R 13/426 439/352
3,937,547 A 2/1976 Lee-Kemp
(Continued)

FOREIGN PATENT DOCUMENTS

DE 10236275 B3 1/2004

OTHER PUBLICATIONS

PCT Notification, International Search Report and Written Opinion, Application No. PCT/EP2014/073691, dated Jan. 22, 2015, 10 pages.

(Continued)

*Primary Examiner* — Gary Paumen
(74) *Attorney, Agent, or Firm* — Barley Snyder

(57) ABSTRACT

A plug connector is disclosed. The plug connector comprises a main housing with a cable connection end, an inner sleeve non-releasably arranged on the main housing, and an outer sleeve axially fitted over the inner sleeve.

27 Claims, 6 Drawing Sheets

(56) References Cited

U.S. PATENT DOCUMENTS

| | | | | |
|---|---|---|---|---|
| 4,090,764 | A * | 5/1978 | Malsby | H01R 13/514 439/471 |
| 6,056,577 | A | 5/2000 | Blanchet | |
| 6,506,071 | B2 * | 1/2003 | Lange | H01R 9/26 439/358 |
| 7,316,591 | B2 * | 1/2008 | Ferderer | H01R 13/518 439/532 |
| 8,668,530 | B2 * | 3/2014 | Riepe | H01R 13/518 439/532 |
| 2007/0020973 | A1 | 1/2007 | Sattele et al. | |
| 2007/0232116 | A1 | 10/2007 | Bernat et al. | |
| 2010/0173513 | A1 | 7/2010 | Bergner et al. | |

OTHER PUBLICATIONS

German Office Action, dated Oct. 9, 2014, 8 pages.

* cited by examiner

PLUG TYPE CONNECTOR

CROSS-REFERENCE TO RELATED APPLICATIONS

This application is a continuation of PCT International Patent Application No. PCT/EP2014/073691, filed Nov. 4, 2014, which claims priority under 35 U.S.C. §119 to German Patent Application No. 102013222411.7, filed Nov. 5, 2013.

FIELD OF THE INVENTION

The present invention relates to a plug connector, and more particularly, to a plug connector with a locking device.

BACKGROUND

Known lockable plug connector systems, including a plug connector and an axially connected plug counter-connector, are protected against unintentional disengagement by means of locking devices. The known plug connector generally comprises two housing portions, a connector body and a sliding sleeve which is arranged in an axially movable manner. When the plug system is assembled, the plug counter-connector and the plug connector are engaged by means of the sliding sleeve. When the plug system is disassembled, the sliding sleeve is displaced in an insertion direction away from the plug counter-connector in order to release the engagement of the plug system.

Generally, such known plug systems are electrical plug connections which are intended to be constructed in a correspondingly robust and durable manner. It has been found to be disadvantageous for the connector body and the sliding sleeve to be produced from a non-resilient material, for example, a metal. Furthermore, previously known plug connectors with catch connections are cost-intensive to produce.

SUMMARY

An object of the invention, among others, is to provide a plug connector which connects the housing portions of the plug connector which do not comprise resilient material in a simple, reliable, and durable manner, and which can be releasably connected to a corresponding plug counter-connector in a simple, reliable, and durable manner. The disclosed plug connector comprises a main housing with a cable connection end, an inner sleeve non-releasably arranged on the main housing, and an outer sleeve axially fitted over the inner sleeve.

BRIEF DESCRIPTION OF THE DRAWINGS

The invention will now be described by way of example with reference to the accompanying figures, of which.

DETAILED DESCRIPTION OF EMBODIMENT(S)

The invention is explained in greater detail below with reference to embodiments of a plug connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
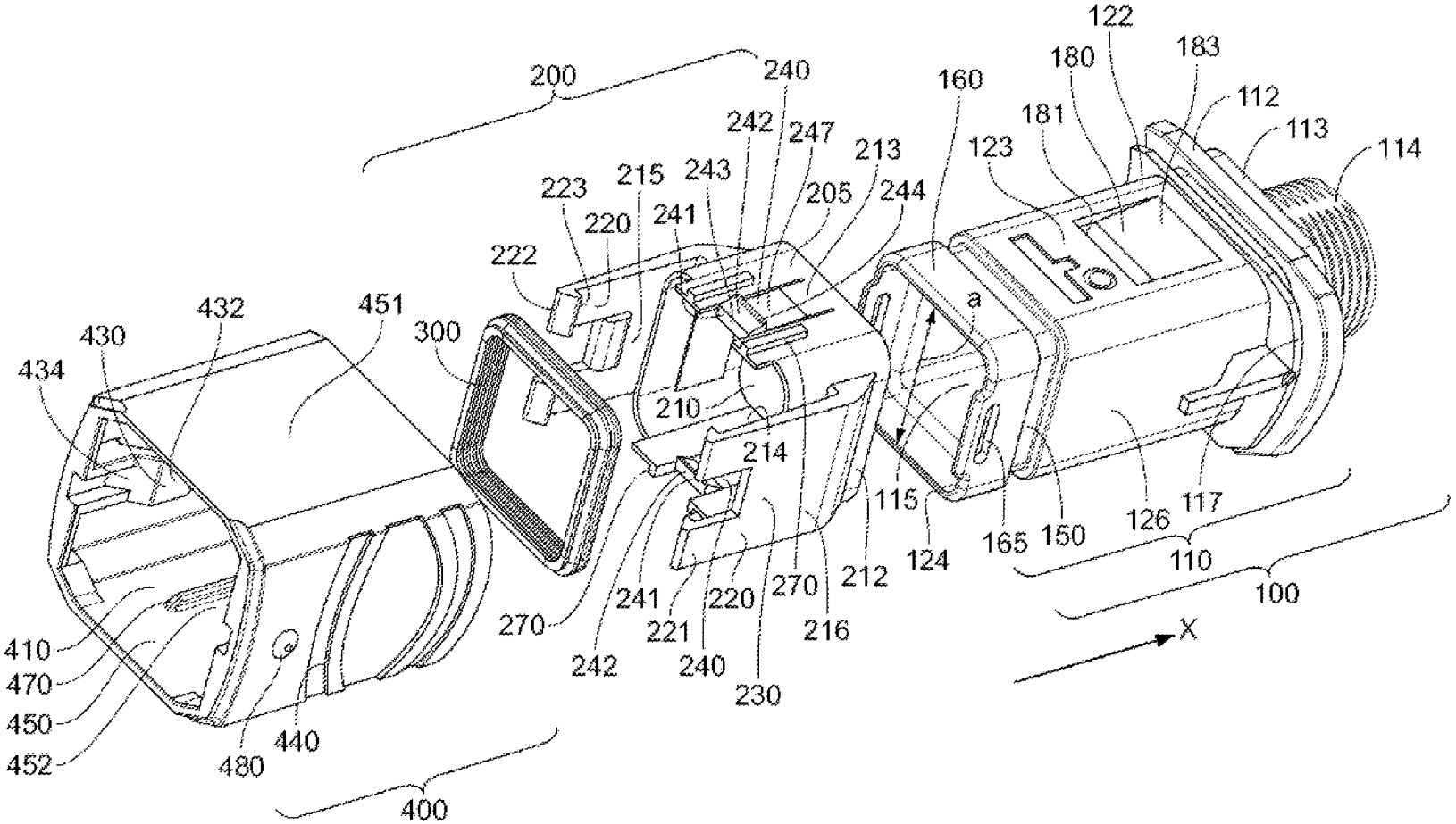
FIG. 1 is an exploded, perspective view of a plug connector according to the present invention.

A plug connector according to the present invention is shown generally in FIG. 1. The plug connector includes a connector body 100, an inner sleeve 200, a sealing ring 300, and an outer sleeve 400. The major components of the invention will now be described in greater detail.

The connector body 100, as shown in FIG. 1, comprises a bush-like main housing 110 which has a main wall 122 and which is constructed in a rectangular manner with rounded edges. Furthermore, the main housing 110 has at one end thereof at least one collar 112 having a projection 113 and an end-side cable connection element 114 which is axially arranged thereon. The cable connection element 114 is constructed in a round manner and has from the free end thereof to the projection 113 an outer thread. Furthermore, in the cable connection element 114 there is formed a passage which communicates with a passage 115 which is delimited by the main housing 110. A support collar 117 is arranged upstream of the collar 112 in the insertion direction.

The cable connection element 114 may be formed from a metal, but may also be formed from another material, for example, a plastic. Both the projection 113 which may be integrated in the collar 112 and the main housing 110 are produced from a non-flexible or non-resilient material, such as a non-flexible or non-resilient metal or non-flexible or non-resilient plastics-containing material, for example, by means of an injection-moulding method.

The main housing 110 comprises a first region 123 and a second region 124. Mutually opposing regions 123, 124 of the main wall 122, whose outer sides are spaced apart from each other by the dimension a shown in FIG. 1, have recesses 180. The recesses 180 each form at the side 181 facing away from the collar 112 and at a right angle with respect to the two regions 123, 124. The side 182 of the recess 180 facing the collar 112 in contrast extends radially inwards and thus forms in each case with one of the two regions 123, 124 of the main wall 122 an oblique surface 183.

The main wall 122 of the main housing 110 forms on the side opposite the collar 112 a sliding face which is upstream in a radially inward direction, there being formed in the insertion direction x a peripheral groove 150, and adjacent thereto a peripheral end face 160 being arranged upstream. The front end face 160 of the main housing 110 has the same diameter as the main wall 122 and comprises slots 165 which extend transversely relative to the insertion direction.

Figure 4:
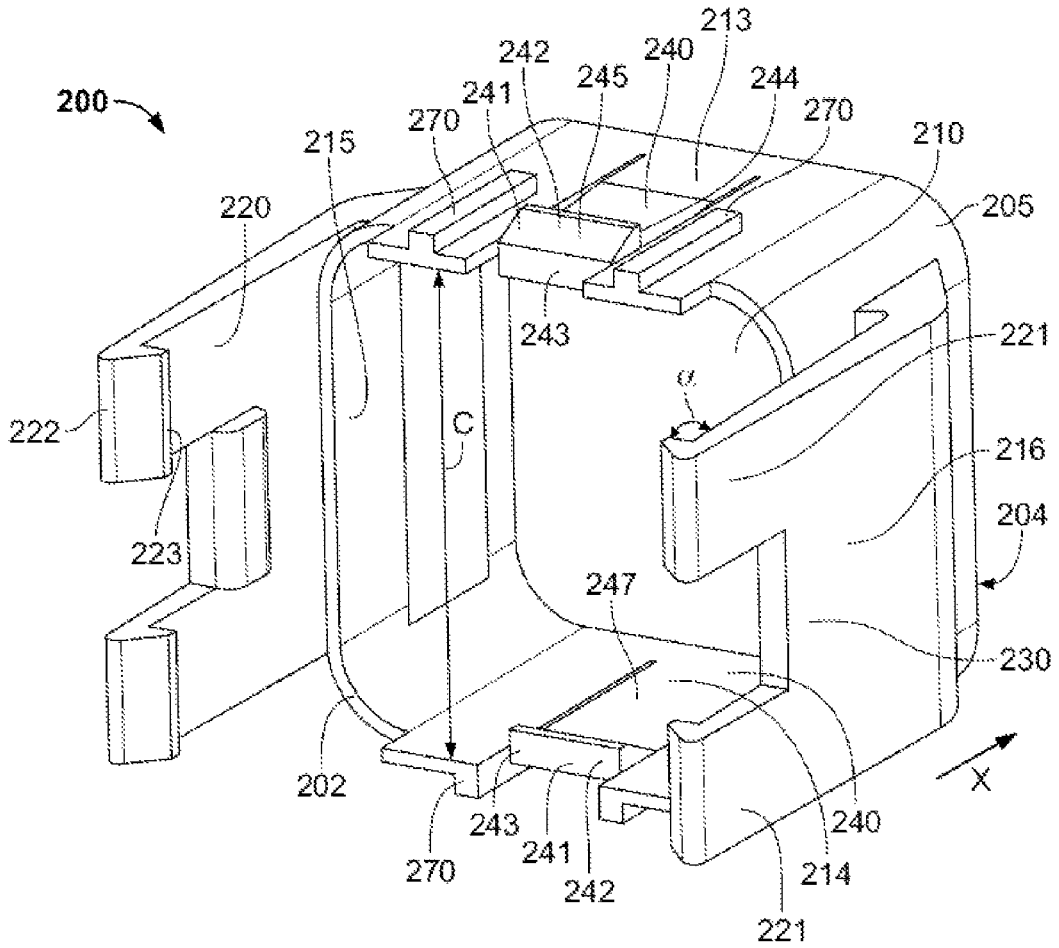
FIG. 4 is a perspective view of an inner sleeve of the plug connector of FIG. 1.

The inner sleeve 200, as shown in FIGS. 1 and 4, has a bush-like wall 205 formed in a rectangular manner with rounded edges, having a first side 202 and a second side 204, and defining a through-opening 210. The inner sleeve 200 has a first region 213 and a second region 214 which are opposite each other on the wall 205. Furthermore, the inner sleeve 200 has in these two regions 213, 214 two guiding elements 270 constructed in a rail-like manner and extending parallel with the insertion direction x and a resilient locking element 240 which is arranged between the guiding elements 270, the locking elements 240 partially protruding in the outer and in the inner direction of the bush-like inner sleeve 200 beyond the wall 205.

As shown in FIG. 4, the resilient locking elements 240 extend through a resilient tongue 247 which extends in an axial direction of the inner sleeve 200 and which is connected at one end to the inner sleeve 200. The resilient locking elements 240 have at opposite free ends 241 thereof a locking means 242 which, on the one hand, protrudes at the first side 243 thereof transversely relative to the axial direction and radially inwards and, on the other hand, protrudes at the second side 244 thereof transversely relative to the axial direction and radially outwards. The first side 243 and the second side 244 are connected to each other by means of a first radially outwardly directed outer sliding face 245 and a radially inwardly directed inner sliding face 246. The two sliding faces 245, 246 are arranged parallel with each other and mutually spaced apart in such a manner that the locking means 242 is constructed in the form of a parallelogram to the greatest possible extent.

The inner sleeve 200 also has a third region 215 and a fourth region 216 which are opposite each other on the wall 205. At these two regions 215, 216, a catch element 220 has two resilient tongues 221 which are arranged parallel with each other and spaced apart from each other and which are connected to each other by means of a connection element 230 which extends transversely relative to the axial direction. The tongues 221 each have a free end 222 with catch hooks 223 which protrude transversely relative to the axial direction and in a radially inward direction. The protruding portion of the catch hooks 223 forms with a radially inwardly directed lower side of the tongues 221 an angle $\alpha$, shown in FIG. 4, and extends outwards in an axial direction in a radially oblique manner, forming oblique catch hook faces 224.

The sealing ring 300 shown in FIG. 1 may be an O-ring. The sealing ring 300 may be formed from an elastically deformable material, such as rubber.

Figure 2:
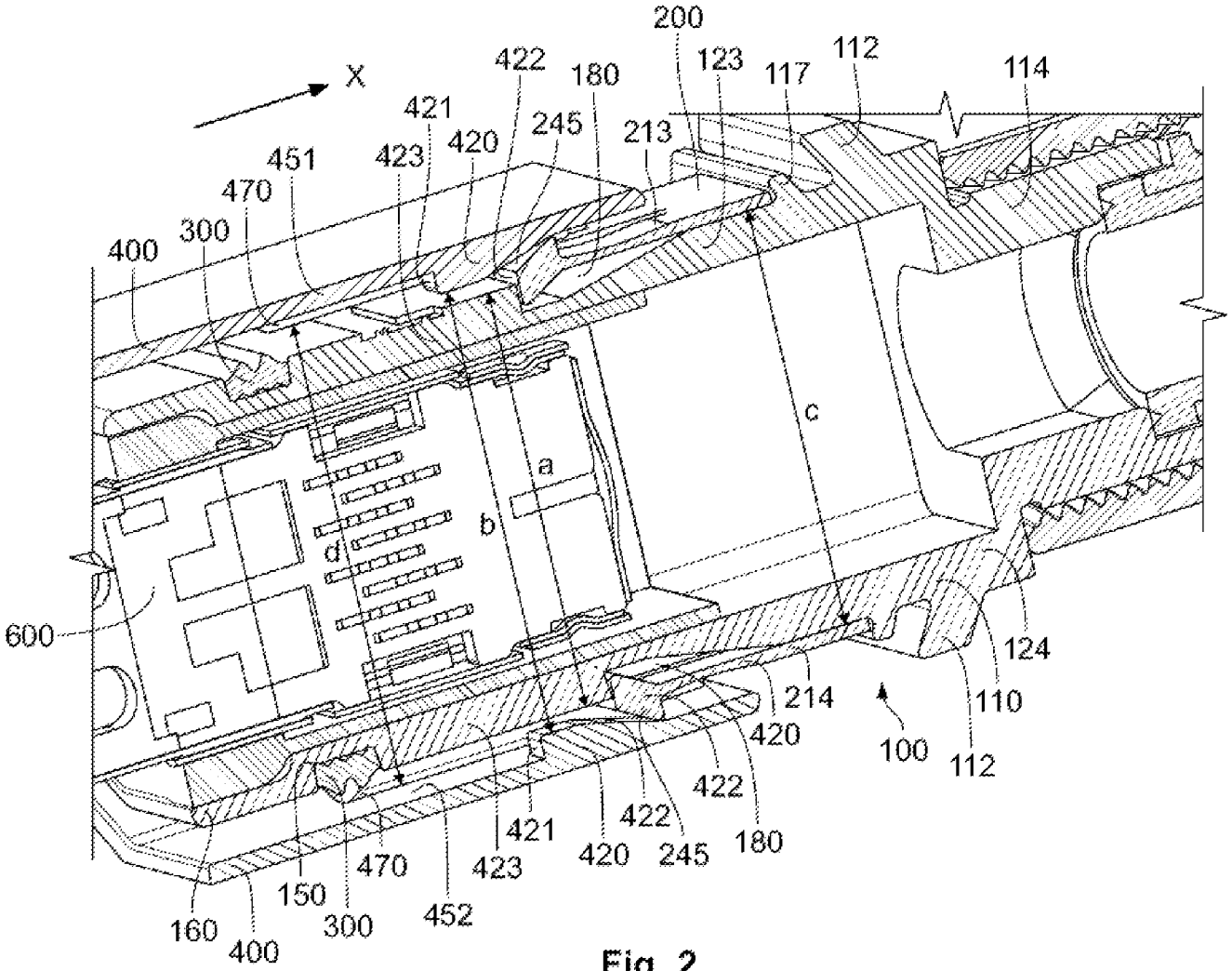
FIG. 2 is a sectional view of the plug connector of FIG. 1.

The outer sleeve 400, as shown in FIG. 1, defines a passage 410. Two mutually opposing regions 451, 452 of an inner wall 450 are spaced apart from each other by a dimension d, as shown in FIG. 2. The outer sleeve 400 may be produced from a non-flexible or non-resilient material, such as a non-flexible or non-resilient metal or non-flexible or non-resilient plastics-containing material, for example, by means of an injection-moulding method.

The outer sleeve 400 comprises in each case at the inner side an unlocking element 430. The unlocking element 430 is formed in an integral manner with the outer sleeve 400 and comprises a guiding member 432 and a lifting member 434 which carries the guiding member 432 and which is formed at the side facing away from the main housing 110 in such a manner that the guiding member 432 forms with the lifting member 434 an angle greater than 90°. The outer sleeve 400 further has at the inner side thereof four rail-like guiding counter-elements 470 extending parallel with the insertion direction x.

The catch projection 420 of the outer sleeve 400 has at the side facing away from the connector body 100 a counter-stop 421 and a face 422 which extends from the counter-stop 421 first parallel with the inner side of the outer sleeve 400 and subsequently in a radially outward direction to the inner side of the outer sleeve 400. The catch projections 420 have inwardly directed tips 423 are spaced apart from each other by means of at least a third dimension b, shown in FIG. 2.

The outer sleeve 400 has at the outer surface side opposite the unlocking element 430 gripping bars 440 in order to simplify manual fitting of the outer sleeve 400 on the connector body 100 and the axial movement of the outer sleeve 400 on the connector body 100. The outer sleeve 400 further comprises, on the outer surface side between the gripping bars 440 and the outer surface side edge opposite it, a display means 480 which is integrated in the outer sleeve 400 and which is formed as a projection.

The assembly of the connector body 100, inner sleeve 200, sealing ring 300, and outer sleeve 400 will now be described in greater detail with reference to FIGS. 1-3.

As shown in FIG. 2, the connector body 100 is inserted through the inner sleeve 200, and the inner sleeve 200 is disposed around the connector body 100. The through opening 210 receives the main housing 110 so that the inner sleeve 200 can be fitted onto the main housing 110. Recesses 180 of the opposing regions 123, 124 are formed in such a manner that they receive the locking means 242 of the inner sleeve 200 in a positive-locking manner forming a counter-stop for the first side 243. The inner sliding face 246 of the locking means 242 also forms an oblique guiding face so that the locking means 242 during the insertion operation slide between the inner sleeve 200 and the main housing 110 over one of the two regions 123, 124 of the main wall 122. As a result of the oblique sliding faces 246 of the locking means 242, the resilient locking elements 240, starting from a starting position during the insertion operation, are resiliently deformed in a radially outward direction and, at the time at which the locking means 242 with the free ends 241 thereof reach the recesses 180 of the main housing 110, spring back into the respective starting position thereof and engage at that location with the side 181 facing away from the collar 112 so that the inner sleeve 200 can no longer be released from the main housing 110.

Figure 3:
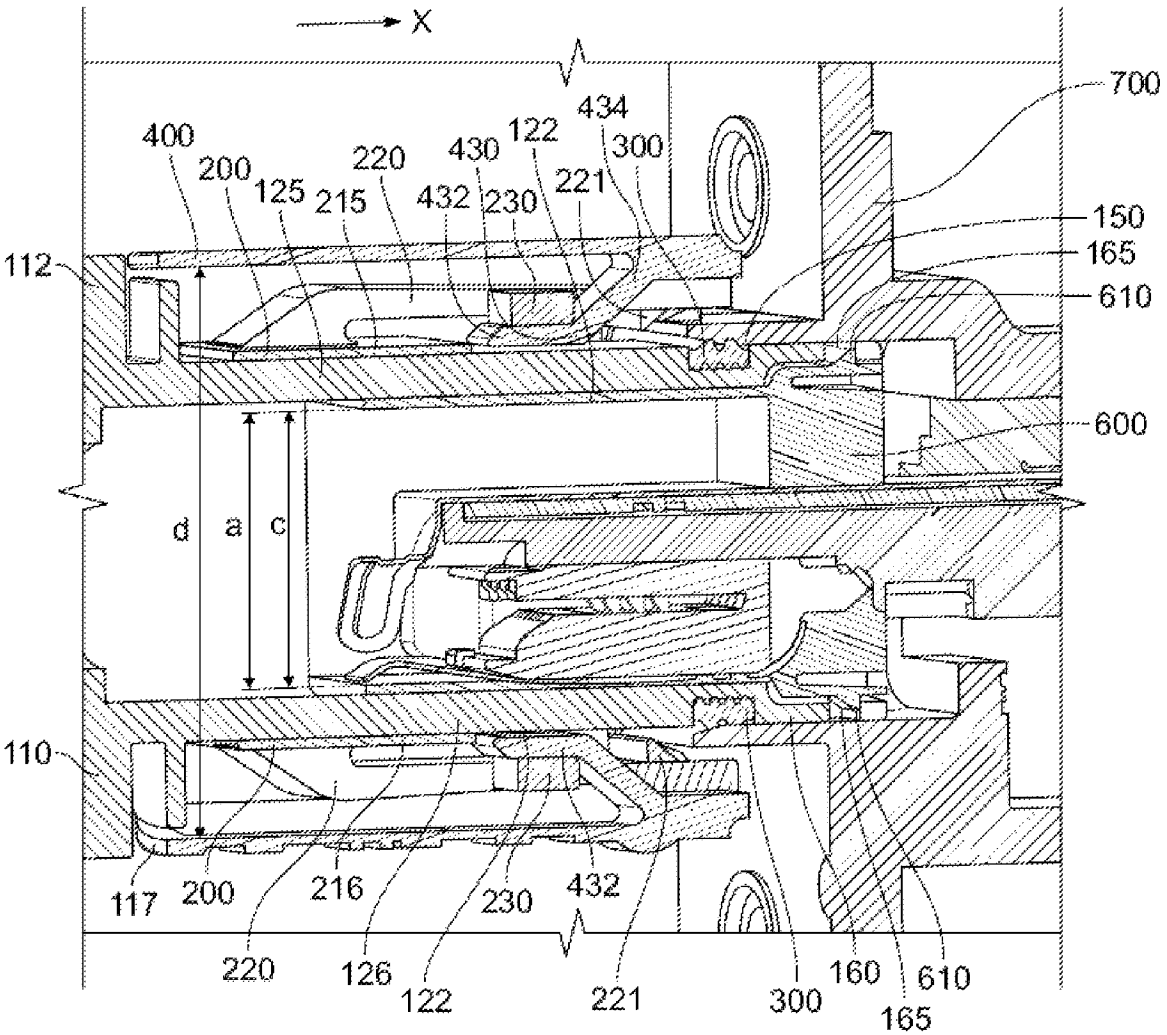
FIG. 3 is a sectional view of the plug connector of FIG. 1.

The outer sleeve 400 is disposed around both the connector body 100 and the inner sleeve 200, as shown in FIGS. 2 and 3. The passage 410 has an outer diameter which substantially corresponds to the collar 112 of the main housing 110 and an inner diameter which is suitable for receiving the connector body 100. In FIG. 2, the outer sleeve 400 has already partially been pushed over the connector body 100 so that the main housing 110 in this instance protrudes with the end face 160 thereof and the slots 165 which are formed therein into the through-opening 410 of the outer sleeve 400.

The rail-like guiding counter-elements 470 correspond to the four rail-like guiding elements 270 at the outer side of the inner sleeve 200 in such a manner that a central fitting of the outer sleeve 400 on the inner sleeve 200 is ensured. The locking element 240 is arranged between the two guiding elements 270 of the inner sleeve 200, and the catch projection 420 is arranged between the guiding counter-elements 470 of the outer sleeve 400. The guiding counter-elements 470 and the catch projections 420 are vertically arranged in such a manner that the guiding counter-elements 470 are guided on the guiding elements 270 of the inner sleeve 200 during the insertion operation, the inwardly directed tips 423 of the catch projections 420 being spaced apart from each other by the dimension b. Furthermore, the catch projections 420 are shaped in such a manner that they form a positive-locking connection with the locking means 242 of the inner sleeve 200.

Since the guiding counter-elements 470 are guided in the corresponding gaps of the guiding elements 270 and the connector body 100 is in play-free abutment with the guiding elements 270 of the inner sleeve 200 against the outer sleeve 400, and at the same time the outer sleeve 400 is in play-free abutment with the guiding counter-elements 470 against the connector body 100, a rotational movement of the outer sleeve 400 during the fitting operation can be prevented to the greatest possible extent. The horizontal play-free abutment of the outer sleeve 400 against the connector body 100 via the unlocking elements 430, when the outer sleeve 400 is further pushed, additionally enables tilt-free, substantially play-free abutment and easy guiding of the guiding members 432 of the unlocking element 430 on the main housing 110. Each guiding member 432 in this instance has at the end side a substantially rounded end, whereby this end acts as a sliding ramp when the outer sleeve 400 is fitted onto the connector body 100. In this instance, a radially outwardly directed side of the guiding members 432 first moves into pretension-free abutment with the connection elements 230.

The upper oblique sliding face 245 of the locking means 242 also forms an oblique guiding face so that the locking means 242, whilst the outer sleeve 400 is fitted over the catch means 200 and the main housing 110, slide over the oblique face 422 of the catch projections 420. In this instance, the catch projections 420 of the outer sleeve 400 are fitted further over the radially outwardly directed outer sliding faces 245 of the locking means 424 as far as the second side 244 of the locking means 242 which protrudes radially outwards. The locking element 240 starting from a starting position is pressed further resiliently downwards during the insertion operation in the direction of the recess 180 and becomes deformed in such a manner that the locking means 242 with the inwardly directed lower sliding face 246 thereof and the adjacent tongue 247 is placed on the oblique face of the recess 180 in a positive-locking manner. After the catch projections 420 have passed the locking means 242 of the inner sleeve 200, or when the outer sleeve 400 is located in the fully fitted end position thereof, the locking elements 240 and consequently also the locking means 242 spring back into their original position whereby the locking means 242 engage behind the catch projections 420 in a positive-locking manner and engage behind the catch projection 420 with the counter-stop 421 of the outer sleeve 400. In the completely fitted position of the outer sleeve 400 on the main housing 110 and the inner sleeve 200, the locking means 242 is consequently located in a non-deformed starting position.

At full insertion, there is formed at the side of the unlocking element 430 facing the main housing 110 a gap which is suitable for receiving the connection element 230 of the catch element 220. As shown in FIG. 3, the unlocking element 430 receives the connection element 230 with the formed gap in such a manner that the connection element 230, after the outer sleeve 400 has been fitted to the main housing 110 and the inner sleeve 200, is in abutment with the guiding member 432. A spacing between the radially outwardly directed surface of the locking tongues 221 and the inner side of the outer sleeve 400 opposite the gripping bar 440 is further selected to be sufficient in such a manner that, when the outer sleeve 400 is axially moved by means of a pressing force which is first directed radially inwards onto the outer sleeve 400 and subsequently axially directed, the action of the locking tongues 221 owing to the support of the end of the outer sleeve 400 on the support collar 117, which end is close to the collar 112, is not impaired. Even when the support collar 117 is formed in a continuous manner, the support collar 117 may be constructed only on the surface sides of the main housing 110 or have a similar form, which per se requires a supporting function for the outer sleeve 400.

The outer sleeve 400 in FIG. 3 has been completely fitted onto the connector body 100 so that the connector body 100 protrudes through the inner sleeve 200 and, with the end face 160 thereof and the slots 165 which are formed therein, out of the outer sleeve 400. The outer sleeve 400 rests with the radially inwardly directed face of the guiding member 432 of the unlocking element 430 on the main wall 122 of the main housing 110. The connection element 430 has in this instance at the radially inwardly directed side facing away from the collar 112 an inclined portion which corresponds to the inclination of the lifting member 434. The connection element 430 is thereby additionally in abutment with the lifting member 434, whereby a vertical abutment of the outer sleeve 400 against the connector body 100 is achieved.

Owing to the configuration of the locking means 242 at the side 182 of the recesses 180 facing the collar 112, the outer sleeve 400 is prevented from sliding away, whereby a non-releasable connection between the main housing 110 and the inner sleeve 200 is brought about. At the same time, a releasable connection is enabled between the main housing 110 and the outer sleeve 400. After the outer sleeve 400 has been fitted to the connector body 100, the outer sleeve 400 comes into contact with the collar 112 and is limited in the insertion direction. The guiding elements 270 and the guiding counter-elements 470 are further constructed in such a manner that the surface side thereof facing the connector body 100 or the inner side of the outer sleeve 400 comes into sliding contact therewith. A horizontal abutment of the outer sleeve 400 with the connector body 100 is thereby achieved.

The gap which is formed by the guiding member 432 and the inner sleeve 200 and which receives the connection element 230 has such a height that the connection element 230 lifts the resilient locking tongues 221 from the main housing 110 when the outer sleeve 400 is moved in the insertion direction x in order to release the plug connection to such an extent that it is displaced into an unlocking state, whereby the plug connector can be removed from the plug counter-connector in a simple manner.

The groove 150 may, for example, receive the sealing ring 300 in order to seal an intermediate space formed after the engagement between the main housing 110 and the outer sleeve 400 so that protection against dust and water is ensured.

The plug connector according to the invention may also connect to a connector block 600 and a plug counter-connector 700. As shown in FIG. 2, the slots 165 may receive catch hooks 610 of the connector block 600 which can be inserted into the connector body 100 in order to engage the connector block 600 with the connector body 100. Additionally, the oblique catch hook faces 224 each form a guiding face via which the catch element 220 together with a face of the plug counter-connector 700 slides into a recess which is provided to receive the catch hooks 223, as shown in FIG. 3. Locking of the inner sleeve 200 and consequently the entire connector body 100 with the plug counter-connector 700 is thereby achieved.

Figure 5:
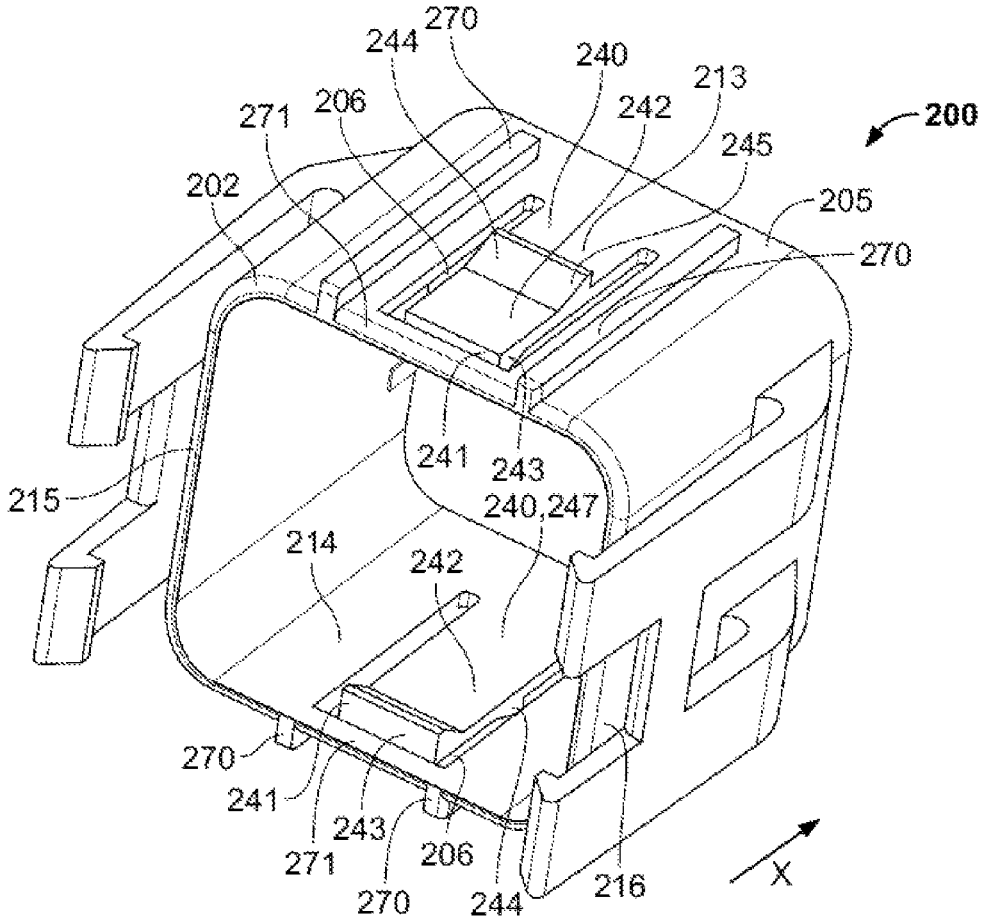
FIG. 5 is a perspective view of an inner sleeve according to another embodiment of the invention.
Figure 6:
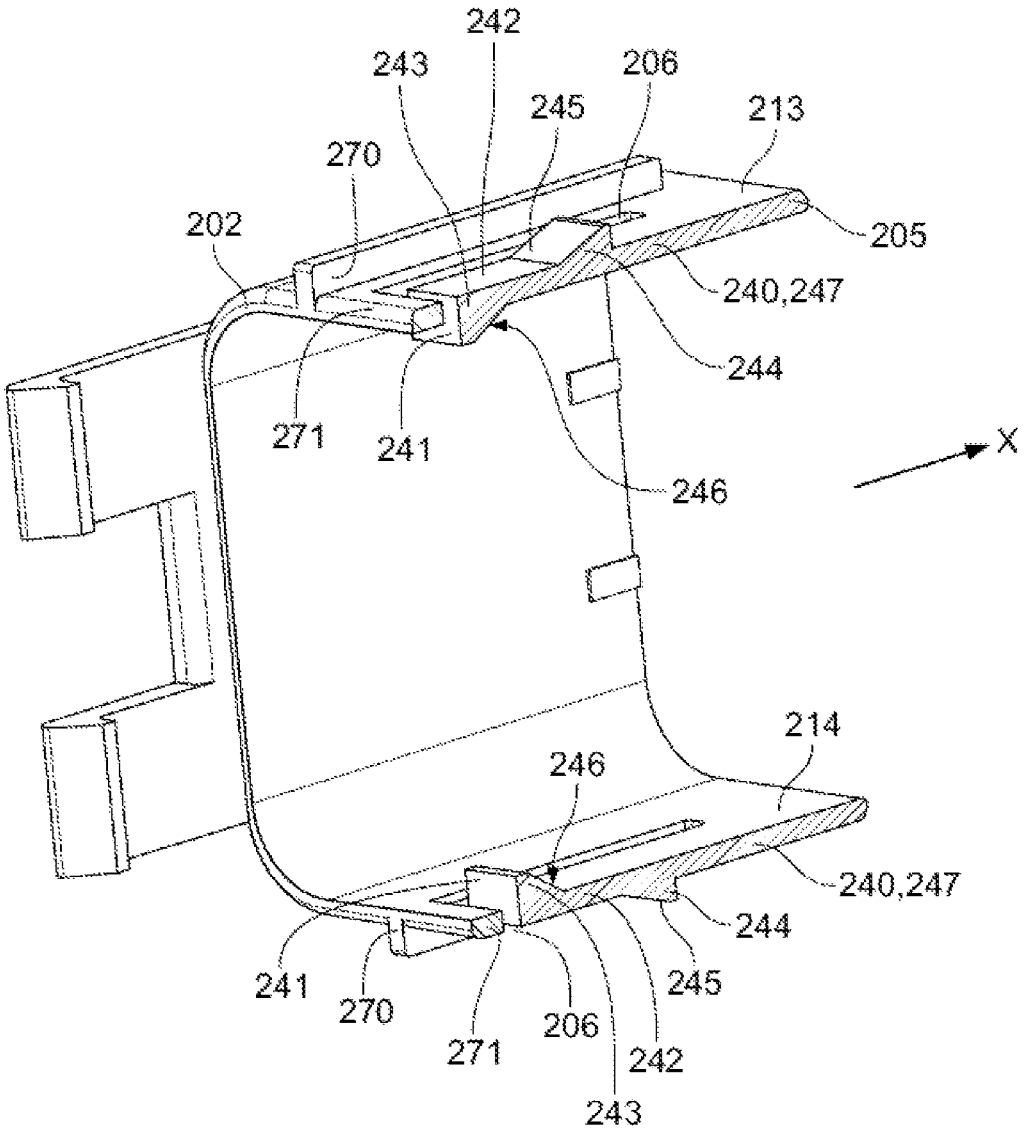
FIG. 6 is a sectional view of the inner sleeve of FIG. 5.

The second variant of the inner sleeve 200 illustrated in FIGS. 5 and 6 is in principle constructed in the same manner as the inner sleeve in FIGS. 1 to 4 so that the reference numerals which have previously been used can accordingly be adopted. The second variant of the inner sleeve 200 differs from the first variant in that the resilient locking element 240 protrudes into a peripherally closed recess 206 of the wall 205. The recess 206 is closed at the first side 202 of the inner sleeve 200 by means of a web-like region 271 of the wall 205, which extends between the two guiding elements 270, with such spacing from the free end 241 of the locking element 240 that the inner sleeve 200 has at the first side 202 thereof a continuous edge, whereby inter alia better stability during the fitting operation can be ensured.

Also in the second variant, the locking element 240 protrudes partially both in a radially outward direction and in a radially inward direction beyond the wall 205 of the bush-like inner sleeve 200. In this instance, the locking elements 240 extend through the resilient tongue 247 which extends in an axial direction of the inner sleeve 200 and which is connected at one side to the inner sleeve 200. At the free end 241 of the tongue 247, there is formed the locking means 242 which, on the one hand, protrudes at a first side 243 transversely relative to the insertion direction x and radially inwards and, on the other hand, protrudes at a second side 244 transversely relative to the insertion direction x and radially outwards. The first side 243 has the first radially inwardly directed sliding face 246 and the second side 244 has the radially outwardly directed sliding face 246. Furthermore, the first side 243 and the second side 244 of the locking means 242 and consequently also the two sliding faces 245, 246 are arranged in the insertion direction x with spacing from each other.

What is claimed is:

1. A plug connector comprising:

a main housing having a plurality of recesses and a cable connection end;

an inner sleeve non-releasably arranged on the main housing and having a wall with a plurality of resilient locking elements received in the plurality of recesses in a positive-locking manner; and an outer sleeve axially fitted over the inner sleeve, the outer sleeve having a plurality of catch projections with inwardly directed tips.

2. The plug connector of claim 1, wherein one of the resilient locking elements is disposed on each of two mutually opposing regions of the wall.

3. The plug connector of claim 2, wherein each resilient locking element protrudes both in an outward direction and an inward direction beyond the wall.

4. The plug connector of claim 3, wherein inner sides of the two mutually opposing wall regions are spaced apart from each other by a first dimension.

5. The plug connector of claim 4, wherein each resilient locking element has a resilient tongue extending in an axial direction of the inner sleeve, the resilient tongue having a first end connected to the inner sleeve and an opposite free end.

6. The plug connector of claim 5, wherein each resilient locking element has a locking means disposed on the free end.

7. The plug connector of claim 6, wherein a first side of each locking means protrudes inwards from the inner sleeve transversely to the insertion direction, and a second side of each locking means protrudes outwards from the inner sleeve transversely to the insertion direction.

8. The plug connector of claim 7, wherein the first side and the second side of each locking means are connected to each other by an outer sliding face directed radially outwards and an inner sliding face directed radially inwards.

9. The plug connector of claim 8, wherein the outer sliding face and the inner sliding face are arranged in parallel and spaced apart from each other.

10. The plug connector of claim 5, wherein the wall has a web-like region forming a continuous edge at a side adjacent to the free end of the locking element.

11. The plug connector of claim 6, wherein the main housing has a main wall with at least two mutually opposing regions spaced apart by a second dimension.

12. The plug connector of claim 11, wherein the first dimension is greater than the second dimension.

13. The plug connector of claim 12, wherein the outer sleeve has an inner wall with at least two mutually opposing regions spaced apart by a third dimension.

14. The plug connector of claim 13, wherein the inwardly directed tips are spaced apart by a fourth dimension.

15. The plug connector of claim 14, wherein the third dimension is greater than the first dimension, the second dimension, and the fourth dimension.

16. The plug connector of claim 15, wherein the fourth dimension is greater than the first dimension and the second dimension.

17. The plug connector of claim 14, wherein the inwardly directed tips form a positive-locking connection with the locking means.

18. The plug connector of claim 17, wherein the plurality of resilient locking elements are displaced radially outwards from an initial position when the inner sleeve is fitted to the main housing.

19. The plug connector of claim 18, wherein the plurality of resilient locking elements return to the initial position to engage with the plurality of recesses when the inner sleeve is fully inserted into the main housing.

20. The plug connector of claim 19, wherein the catch projections press the plurality of locking means into the plurality of recesses in such a manner that the catch projections can be moved over the plurality of resilient locking elements.

21. The plug connector of claim 20, wherein, after the catch projections have been fitted over the plurality of resilient locking elements, the plurality of resilient locking elements return to the initial position, whereby the locking means engage behind the catch projections in a positive-locking manner.

22. The plug connector of claim 1, wherein the main housing and the outer sleeve are a non-resilient or non-flexible material.

23. The plug connector of claim 21, wherein the main housing and the outer sleeve are a non-resilient or non-flexible metal.

24. The plug connector of claim 1, wherein the inner sleeve has at least two rail-like guiding elements and the outer sleeve has at least two guiding counter-elements, the guiding elements corresponding to the guiding counter-elements in such a manner that a centred fit of the outer sleeve on the inner sleeve is ensured.

25. A plug connector comprising:

a main housing with a cable connection end;

an inner sleeve non-releasably arranged on the main housing and having a wall with a plurality of resilient locking elements, each resilient locking element having a resilient tongue extending in an axial direction of the inner sleeve with a first end connected to the inner sleeve and a locking means disposed on an opposite free end, a first side of each locking means protruding inward from the inner sleeve transversely to the insertion direction and a second side of each locking means protruding outward from the inner sleeve transversely to the insertion direction, the first side and the second side of each locking means connected to each other by an outer sliding face directed radially outwards and an inner sliding face directed radially inwards; and an outer sleeve axially fitted over the inner sleeve.

26. The plug connector of claim 25, wherein the outer sliding face and the inner sliding face are arranged in parallel and spaced apart from each other.

27. A plug connector comprising:

a main housing with a cable connection end;

an inner sleeve non-releasably arranged on the main housing and having a wall with a plurality of resilient locking elements, each resilient locking element having a resilient tongue extending in an axial direction of the inner sleeve with a first end connected to the inner sleeve and an opposite free end, the wall having a web-like region forming a continuous edge at a side adjacent to the free end of each locking element; and an outer sleeve axially fitted over the inner sleeve.

* * * * *